US011817061B2

(12) United States Patent
Martinez et al.

(10) Patent No.: US 11,817,061 B2
(45) Date of Patent: Nov. 14, 2023

(54) CONTROLLING LIGHT INTENSITY OF A DISPLAY PANEL

(71) Applicant: Hewlett-Packard Development Company, L.P., Spring, TX (US)

(72) Inventors: Juan Martinez, Spring, TX (US); Chi So, Spring, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 231 days.

(21) Appl. No.: 17/042,396

(22) PCT Filed: Apr. 30, 2018

(86) PCT No.: PCT/US2018/030212
§ 371 (c)(1),
(2) Date: Sep. 28, 2020

(87) PCT Pub. No.: WO2019/212486
PCT Pub. Date: Nov. 7, 2019

(65) Prior Publication Data

US 2021/0142744 A1 May 13, 2021

(51) Int. Cl.
*G09G 3/34* (2006.01)
*G09G 3/36* (2006.01)

(52) U.S. Cl.
CPC ..... *G09G 3/3426* (2013.01); *G09G 3/36* (2013.01); *G09G 2360/141* (2013.01); *G09G 2360/144* (2013.01); *G09G 2360/145* (2013.01); *G09G 2360/16* (2013.01)

(58) Field of Classification Search
CPC ..... G09G 3/36; G09G 2360/141; G09G 2360/144; G09G 2360/145; G09G 2360/16; G09G 3/3406; G09G 3/34; G09G 3/3413; G09G 3/342
See application file for complete search history.

(56) References Cited

U.S. PATENT DOCUMENTS

| | | | | |
|---|---|---|---|---|
| 8,107,019 | B2 | 1/2012 | Shiota | |
| 8,482,698 | B2 | 7/2013 | Atkins | |
| 8,575,865 | B2 | 11/2013 | Chen et al. | |
| 9,101,001 | B2 | 8/2015 | Wagner | |
| 9,615,418 | B2 | 4/2017 | S | |
| 2009/0231313 | A1* | 9/2009 | Teranishi | G09G 3/3406 345/207 |
| 2009/0243993 | A1 | 10/2009 | Kuga | |
| 2009/0289965 | A1 | 11/2009 | Kurokawa et al. | |
| 2010/0141572 | A1 | 6/2010 | Kamada | |
| 2010/0194288 | A1 | 8/2010 | Nørgaard | |
| 2011/0193872 | A1 | 8/2011 | Biernath et al. | |
| 2011/0267541 | A1 | 11/2011 | Hirokane | |
| 2013/0271704 | A1 | 10/2013 | Zhao et al. | |
| 2013/0314448 | A1* | 11/2013 | Toksvig | G09G 3/342 345/690 |
| 2014/0091210 | A1 | 4/2014 | Hogo et al. | |

(Continued)

*Primary Examiner* — Dennis P Joseph
(74) *Attorney, Agent, or Firm* — Quarles & Brady LLP

(57) ABSTRACT

An example system includes a display panel comprising an adjustable light source. A light sensor is disposed proximate to the display panel on an opposite surface from the adjustable light source. A controller is used to measure an intensity of light from the light sensor and to control an intensity of the adjustable light source, based, at least in part, on the intensity of measured light.

17 Claims, 6 Drawing Sheets

(56) References Cited

U.S. PATENT DOCUMENTS

| | | | | |
|---|---|---|---|---|
| 2014/0285477 | A1* | 9/2014 | Cho | G09G 5/06 345/207 |
| 2015/0070337 | A1* | 3/2015 | Bell | G09G 3/007 345/207 |
| 2016/0314749 | A1 | 10/2016 | Amundson et al. | |

* cited by examiner

100

300

400

CONTROLLING LIGHT INTENSITY OF A DISPLAY PANEL

BACKGROUND

Modern display panels are often based on thin-film transistor (TFT) technologies. In these types of systems, a light source is mounted behind the display panel. The light source may include light emitting diodes (LEDs), florescent lights, edge lights that illuminate reflectors, or the like. A first polarization film is placed over the light source with a polarized light orientation in a first direction. A TFT panel including individually addressable pixels is then placed over the first polarization film. The pixels of the TFT panel may have color filters to enable a color display. A second polarization film is placed over the TFT panel on the opposite side of the TFT panel from the first polarization film. The second polarization film has a polarized light orientation that is perpendicular to the first polarization film, generally preventing light from the light source from passing through the display panel. A transparent cover panel may be mounted over the second polarization film to protect the display and to provide other functions if desired, such as a touch screen. Once the layer structure is completed, the edges, or display border, are sealed and the display panel is mounted in a case.

When a thin-film transistor controlling an individual pixel is activated, light passing through the activated thin-film transistor is rotated from the first direction to the second direction. This allows the light to be transmitted through the second polarization film, making it visible at the front of the display panel.

DESCRIPTION OF THE DRAWINGS

Certain exemplary embodiments are described in the following detailed description and in reference to the drawings, in which.

DETAILED DESCRIPTION

Display borders are getting thinner as manufacturers are maximizing screen size while minimizing the display footprint to save on space. As display borders get thinner, the problem of backlight bleeding becomes more prevalent. Backlight bleeding occurs when the light from the light source that illuminates the display panel from behind escapes the edges of the display. This will cause certain areas of a display to be lighter when displaying a dark background or bright spots to appear on a display in a dark environment.

This disclosure details a method to reduce backlight bleeding in displays. LEDs light the LCD panel from behind are driven by multiple LED drivers that allow independent control of each LED. Sensors are placed along the inside edges of a display to check for backlight bleeding along the edges. A controller monitors the sensors and will dynamically modify the power of each LED to minimize the amount of bleeding in that area.

Figure 1:
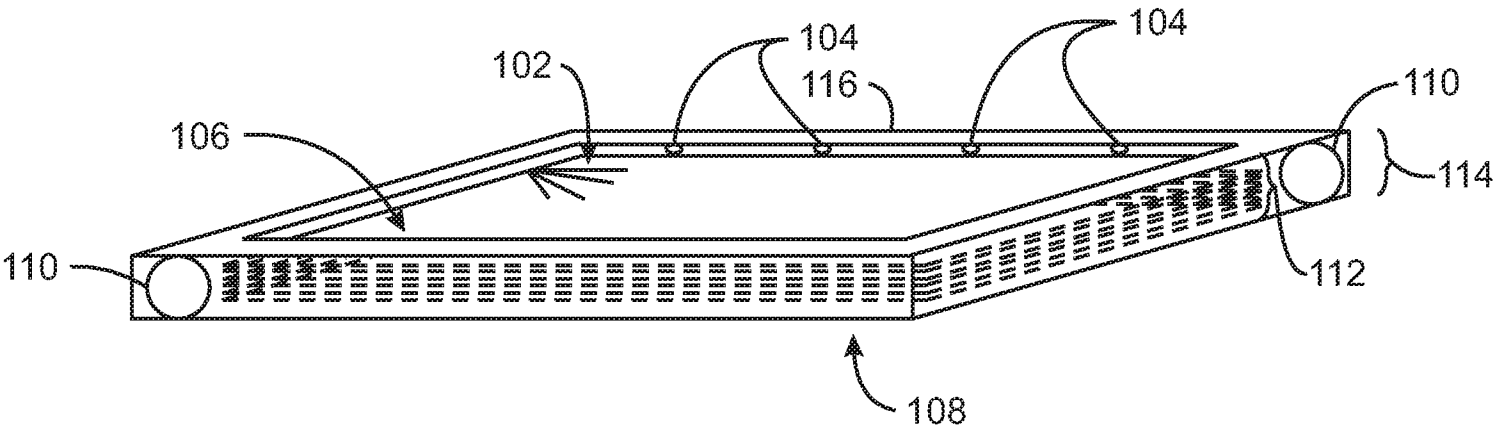
FIG. 1 is a drawing of an example display panel showing light bleed at an edge and sensors to detect the light.

FIG. 1 is a drawing of an example display panel 100 showing light bleed 102 at an edge and sensors 104 to detect light intensity on the display side 106 of the display panel 100. As used herein, the display side 106 is the front side of the panel visible to a user of the display panel 100. The display side 106 is opposite a back side 108 of the display panel 100, for example, holding a light source. The light bleed 102 at the edge of the display panel 100 may be reduced by sealant 110 along the edges contacting the different layers 112 of the display panel 100. Increasing the sealant 110 may help to prevent light from escaping around the edges of the different layers 112 of the display panel 100. However, newer display panels 100 are being reduced in thickness 114, which may make it more difficult to limit backlight from bleeding around the edges of the display panel 100.

The sensors 104 may be placed in a bezel 116 to measure light intensity at the display side 106 of the display panel 100. A controller may compare the light intensity from the sensors 104 to the light intensity expected for a region of the display panel. The controller may then adjust the backlight to match the measured light intensity to the expected light intensity, which may dynamically reduce light bleed 102.

Figure 2:
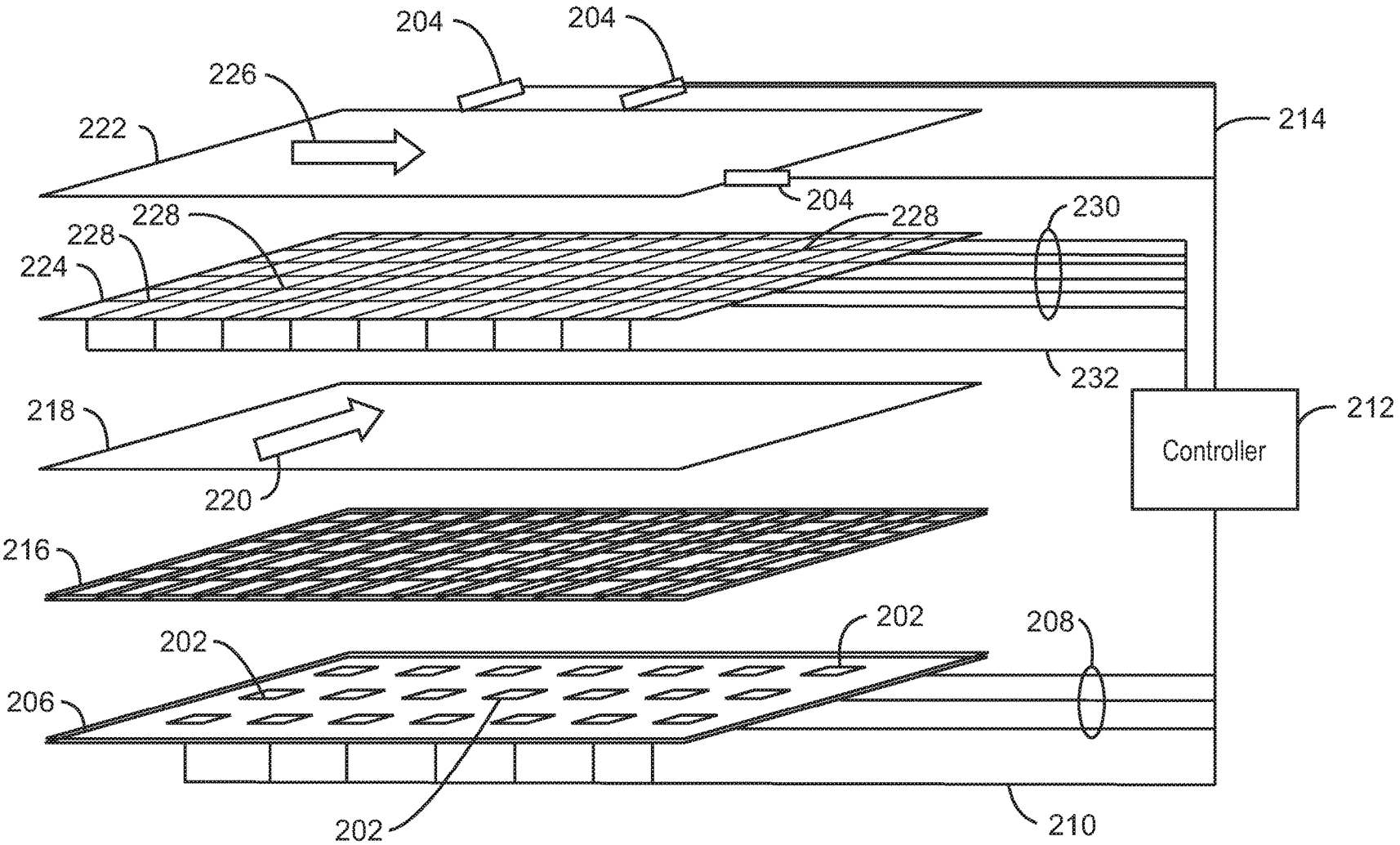
FIG. 2 is an expanded drawing of an example display panel, showing layers that may be present.

FIG. 2 is a drawing of an example display panel 200, showing layers that may be present. The display panel 200 in this example is a liquid crystal display (LCD) panel that is backlit by light emitting diodes (LEDs) 202. As described herein, the techniques may be used with other types of backlights, such as fluorescent tubes, LEDs placed along an edge of a display panel, and the like. To simplify the figure, not every LED 202 is labeled.

In this example of a display panel 200, five functional layers are present. Starting from the back of the display panel 200, opposite the front surface and sensors 204, is a light panel 206 that may hold an array of LEDs 202. In this example, the LEDs 202 may be individually adjustable, for example, using a grid of powerlines 208 and ground lines 210 from a controller 212. Accordingly, the light intensity output by each individual LED 202 may be adjusted by the controller 212, using individual LED drivers. The controller 212 may base the adjustment of the light intensity output by the LEDs 202 on the light intensity measurements from the sensors 204, which may be coupled to the controller 212 through sensor lines 214.

The system is not limited to adjusting the LEDs 202 individually. The LEDs 202 may be wired in different configurations to allow banks of LEDs 202 to be adjusted together. For example, the LEDs 202 along the edges of the display panel may be individually addressable while the LEDs 202 in the center of the display panel are adjusted together.

The light from the light panel 206 may pass through a diffuser panel 216. The diffuser panel 216 scatters or refracts the light from the LEDs 202 to minimize brighter or darker regions.

In a thin filter transistor (TFT) liquid crystal display (LCD) panel, a first polarization filter 218 may be included to polarize the light from the diffuser panel 216. The polarization may orient the light in a first direction 220. A second polarization filter 222 is included and disposed on an opposite side of a TFT panel 224 from the first polarization filter 218. The second polarization filter 222 has a polarization that may orient the light in a second direction 226 that is perpendicular to the first direction 220. Accordingly, the light passing through the first polarization filter 218 is substantially blocked by the second polarization filter 222, for example, with less than 5% of the light passing through, or less than 2% of the light passing through, or less than 0.5% of the light passing through, or lower.

The TFT panel 224 includes an array of individual thin filter transistors 228 that are individually activated by the controller 212, for example, through an array of TFT powerlines 230 and TFT ground lines 232 that allow each thin filter transistor 228 to be individually addressable. When a thin filter transistor 228 is powered it actuates a LCD pixel that rotates the polarization of the light from the first direction 220 the second direction 226. This allows the light to pass through the second polarization filter 222 and be visible to a user.

The example display panel 200 may contain numerous other layers to perform display and input functions. For example, a protective glass panel may be placed over the second polarization filter 222 to protect it from scratches. A touch sensitive screen may also be placed over the second polarization filter 222 or incorporated into a protective glass panel over the second polarization filter 222. Further, the protective glass panel may incorporate the second polarization filter 222. The TFT panel 224 may include color filters over individual pixels to allow a color display to be formed.

The controller 212 may measure the light intensity over the display panel 200, using the sensors 204, which may be placed outside of the display panel 200, for example, in a bezel mounted to the front surface of the display panel 200. The measurement of the light intensity may allow the controller 212 to detect if backlight bleeding is occurring. If so, the controller 212 may adjust the strength of the LED drivers to control the light output of the LEDs 202, for example, by pulse width modulation of a power signal sent over the powerlines 208 to the LEDs 202, among other techniques. The controller 212 may then use the measurements from the sensors 204 to determine if the backlight bleeding has been reduced. This process may be continuously repeated to control the backlight bleeding.

A user may override the sensor controller adjustments to manually adjust the power of the LEDs. This may be performed through hardware controls or through software depending on implementation. Further, the user may adjust the overall power of the LEDs 202 throughout the light panel 206 to increase or decrease the brightness of the display panel 200. The user may adjust the power of LEDs 202 in certain regions to manually decrease backlight bleeding.

Figure 3:
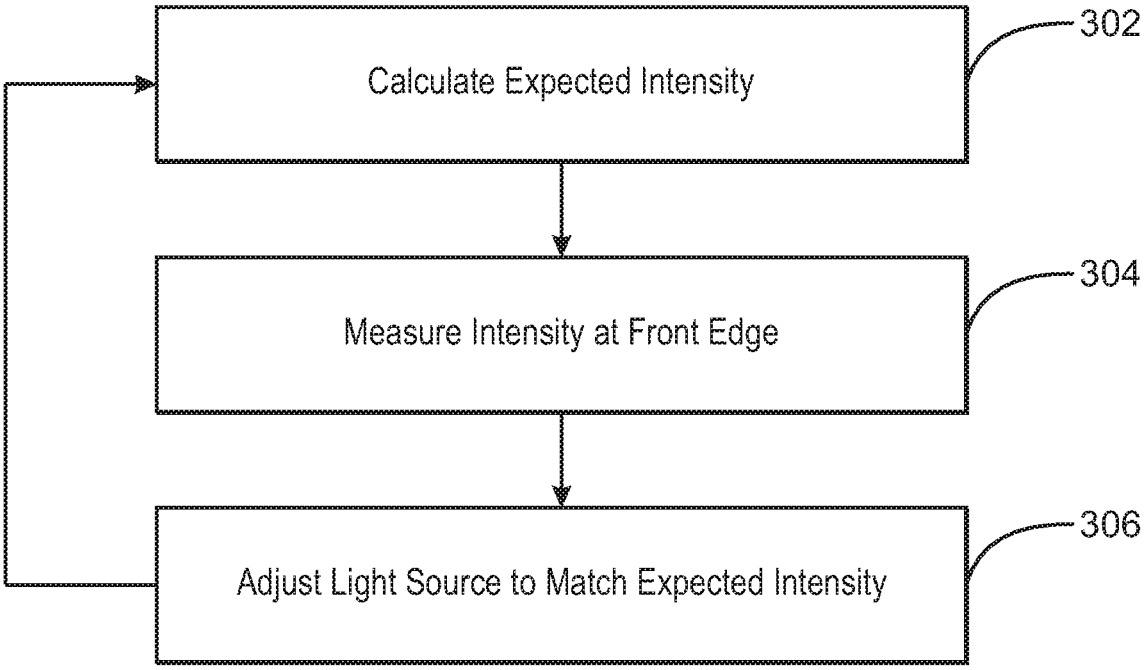
FIG. 3 is a process flow diagram of an example method for adjusting light intensity in a display panel to limit light bleed at an edge.

FIG. 3 is a process flow diagram of an example method 300 for adjusting light intensity in a display panel to limit light bleed at an edge. The method 300 may begin at block 302 with the calculation of an expected intensity for the light emitted by the display panel. This may be for the entire display panel, or for a region of the display panel near a sensor located at the front edge.

At block 304, the intensity of the light emitted by the display panel, for example, at the front edge near a sensor, may be measured. As described herein, the light sensor may be located in a bezel to allow it to measure light over the front surface of the display panel, opposite the light source of the display panel.

At block 306, a controller may adjust the light source to match the measured intensity to the expected intensity. For example, the controller may have the ability to manipulate distinct areas of the backlighting to have fine granular control of the light output in all locations. The light sensors may be used by the controller to measure light intensity along the edges of the display. The controller may then determine if any of the intensity readings are out of bounds, for example, comparing the intensity readings to the expected intensity calculations. This may be used to identify an area of the display panel that is showing light bleeding. If an area of the display panel is showing backlight bleeding, the controller may adjust the output of the light source in that area.

An ambient light sensor may be included in the display panel, for example, mounted in the bezel and pointing away from the display panel. The ambient light sensor may provide a measurement of the intensity of ambient light, which may be used with the calculation of the expected intensity to adjust the light sources. A separate sensor may not be needed. The other sensors pointed inwards, over the front surface of the display panel, may be used to determine an ambient light level.

In this example, instructions or circuitry may operate in the controller to determine if any of the light sensor readings are out of bounds, and therefore light bleeding is occurring, for example, as compared to expected values in a given ambient light environment. If an area of the display is determined to have backlight bleeding, then the controller adjusts the light source of the display to compensate for the light bleed. Thus, the light bleed monitoring may be real-time and continuous. Further, if the ambient light of the environment changes, the controller may dynamically compensate for light bleed, ambient light conditions, or both. For example, if a display is in a room with a window and the sun sets, changing the room lighting, the controller can compensate for light bleed throughout the changing conditions.

Other techniques may be used for the control of the backlight. For example, if an area of the display is bleeding, then the controller may cycle through a pattern of light sources, enabling and disabling the light sources, such as LEDs, to compensate for the light bleed. The controller may determine the pattern based, at least in part, upon the needed light output. The patterns may be simple, such as every other LED in an LED array, or every other row or column in an LED array. Patterns may be implemented using other light sources, such as fluorescent tubes. In this example, fluorescent tubes near the light bleeding may be adjusted to lower the total amount of light in the vicinity the light bleed, while fluorescent tubes farther from the light bleed may be adjusted to increase the total amount of light emitted by the backlight.

Figure 4:
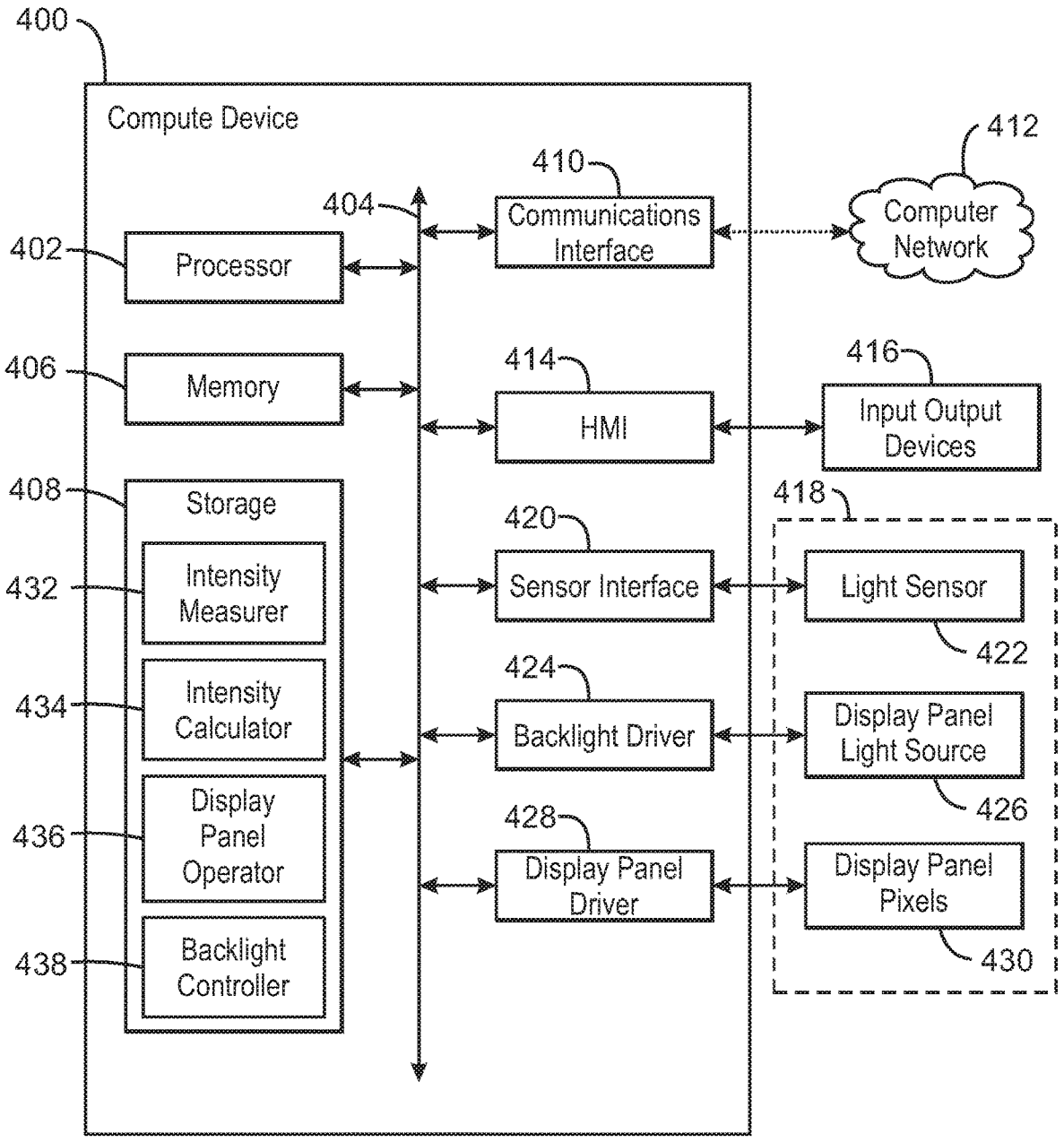
FIG. 4 is a block diagram of an example computing device showing components that may be present to adjust light intensity in a display panel to limit light bleed at an edge.

FIG. 4 is a block diagram of an example compute device 400 showing components that may be present to adjust light intensity in a display panel to limit light bleed at an edge. The compute device 400 may be a part of a display panel, a desktop computer, a laptop, tablet, a mobile phone, or a smart device, among others. The compute device 400 may perform other functions, in addition to the light control functions described herein, or may be a dedicated compute device 400, such as a system-on-a-chip (SoC) located within a display panel.

The compute device 400 may include a processor 402. The processor 402 may be a single core processor, a multicore processor, a processor cluster, or the like. The processor 402 may include, or be replaced by, an application specific integrated circuit (ASIC), a field programmable gate array (FPGA), or any combinations thereof, to implement the light controlling functions described herein. The processor 402 can be coupled to other units through a bus 404. The bus 404 can include peripheral component interconnect (PCI) or peripheral component interconnect express (PCIe) interconnects, Peripheral Component Interconnect eXtended (PCIx), a proprietary bus as part of an SoC or any number of other suitable technologies for coupling together functional units.

The processor 402 may be coupled through the bus 404 to a memory 406. The memory 406 can include random access memory (RAM), including volatile memory such as static random-access memory (SRAM) and dynamic random-access memory (DRAM). The system memory 406 can include directly addressable non-volatile memory, such as resistive random-access memory (RRAM), phase-change memory (PCRAM), memristor, magnetoresistive random-access memory, (MRAM), spin-transfer torque Random Access Memory (STTRAM), and any other suitable memory that can be used to provide computers with persistent memory. The memory may be used to implement persistent memory, or non-volatile storage, if it can be directly addressed by the processor at a byte or word granularity and has non-volatile properties.

Further, the compute device 400 may include a separate non-transitory, machine-readable storage media, such as a storage 408 for the long-term storage of data, including machine-readable instructions to implement the lighting control functions described herein, an image for the display panel, instructions to receive image data from a processor, and instructions to display the image data on a display panel. The storage 408 may include a hard disk, an optical drive, a solid-state disk drive, or other non-volatile storage elements. In some examples, the memory 406 and the storage device 408 may be combined into a single unit. Further, the machine-readable instructions may correspond to hardwired programming of an ASIC or an FPGA.

The compute device 400 can include a communications interface 410. The function of the communications interface 410 may depend on the environment of the compute device 400. For example, if the compute device 400 is part of a display panel the communications interface 410 may be a display interface, coupling to a computer or network 412 through a display port, an HDMI interface, a DVI interface, an RGB interface, or the like. If the compute device 400 is a full function device, the communications interface 410 may include a network interface controller (NIC), a wireless communications transceiver, or both, to allow the compute device 400 to couple to a network. The network may be an enterprise server network, a storage area network (SAN), a local area network (LAN), a wide-area network (WAN), or the Internet, for example.

The processor 402 may be coupled through the bus 404 to a human machine interface (HMI) 414. The HMI 414 may be used to couple the compute device 400 to input/output (I/O) devices 416. The I/O devices 416 may include a keypad, a touchscreen, a mouse, a keyboard, a button, a speaker, an LED, or the like. Accordingly, the HMI 414 may include a USB interface, a speaker interface, digital input/output interfaces, a touchscreen scanner, or any other devices known in the art.

A display panel 418 may be coupled to the compute device 400. The display panel 418 and the compute device 400 may be in a single case, such as the case of the display panel 418. The compute device 400 may have a sensor interface 420 to interface to light sensors 422, for example, mounted in a bezel around the front surface of the display panel 418. The sensor interface 420 may include analog-to-digital converters (ADCs) to convert signals from the light sensors 422 into digital signals that can be provided to the processor 402 through the bus 404. The light sensors 422 may include phototransistors, photodiodes, photoresistors, and the like. A highest sensitivity of the light sensors 422 may be achieved using phototransistors.

A backlight driver 424 may be used to drive the display panel light source 426 as described herein. The type of the backlight driver 424 depends on the lighting technology used for the display panel light source. For an LED light source the backlight driver 424 may couple digital outputs to MOSFET transistors driving individual source and sink lines to LEDs. The light intensity of the LEDs may be controlled by oscillating the digital outputs to control the total current to an LED. In another example, a digital-to-analog converter (DAC) may be used to control the frequency of an oscillator circuit to drive the MOSFET transistors on the source and sink lines to the LEDs and adjust the intensity of the individual LEDs. Any number of other configurations may be used to drive the LEDs including, for example, driving each source line from a MOSFET transistor couple to the analog output of a DAC.

Other lighting technologies may use similar adjustments to control the light intensity of the light source for the display panel 418. For example, the intensity of a florescent tube may be adjusted by controlling a frequency fed to the driver of the fluorescent tube.

A display panel driver 428 may be used to drive the individual display panel pixels 430 of the display panel 418. The display panel driver 428 may use any number of technologies known in the art.

The storage 408 may include modules and data that comprise instructions to direct the processor 402 to implement the functions described herein. However, the modules may be implemented in any number of configurations while staying within the scope of the present claims. Further, a portion, or all, of the instructions may be hardcoded into an ASIC, an FPGA, or other circuitry.

The modules may include an intensity measurer 432. The intensity measurer 432 directs the processor 402 to measure the light intensity over the visible, or outer, surface of the display panel 418, opposite the light source for the display panel. If the light sensors 422 include an ambient light sensor, directed away from the display panel, the intensity measurer 432 may also direct the processor 402 to measure the ambient light intensity for purposes of the intensity calculations.

An intensity calculator 434 may use measurements of the light intensity over the visible surface of the display panel 418, and ambient light intensity measurements, if collected, to calculate the expected light intensity over a region of the display panel 418.

A display panel operator 436 may include several frames of data to be displayed, and the instructions to control the display panel driver 428 to provide values to the individual display panel pixels 430 in the display panel 418. The intensity calculator 434 may use data, for example, values of pixels for a frame of data to be displayed, from the display panel operator 436 to determine the expected or inherent brightness of a region of the display panel 418. The expected brightness of the region may be determined, based at least in part, on the values for the pixels in the region. This may be performed as described with respect to the method of FIG. 3.

The storage 408 may include a backlight controller 438 used to adjust the light intensity of a portion or all of the display panel light source 426. As described herein, this may be performed by providing a pulse width modulated signal to the backlight driver 424 to change the intensity of portions of the display panel light source 426.

It is to be understood that the block diagram of FIG. 4 is not intended to indicate that the computing device 400 is to include all of the components shown in FIG. 4. Rather, the computing device 400 can include fewer or additional components not illustrated in FIG. 4. For example, as described herein, the memory 406 and the storage 408 may be combined into a single non-transitory storage unit. Further, any, or all, of the modules 432-438, shown in the storage 408 may be hardcoded into an ASIC, an FPGA, or other circuitry.

Figure 5:
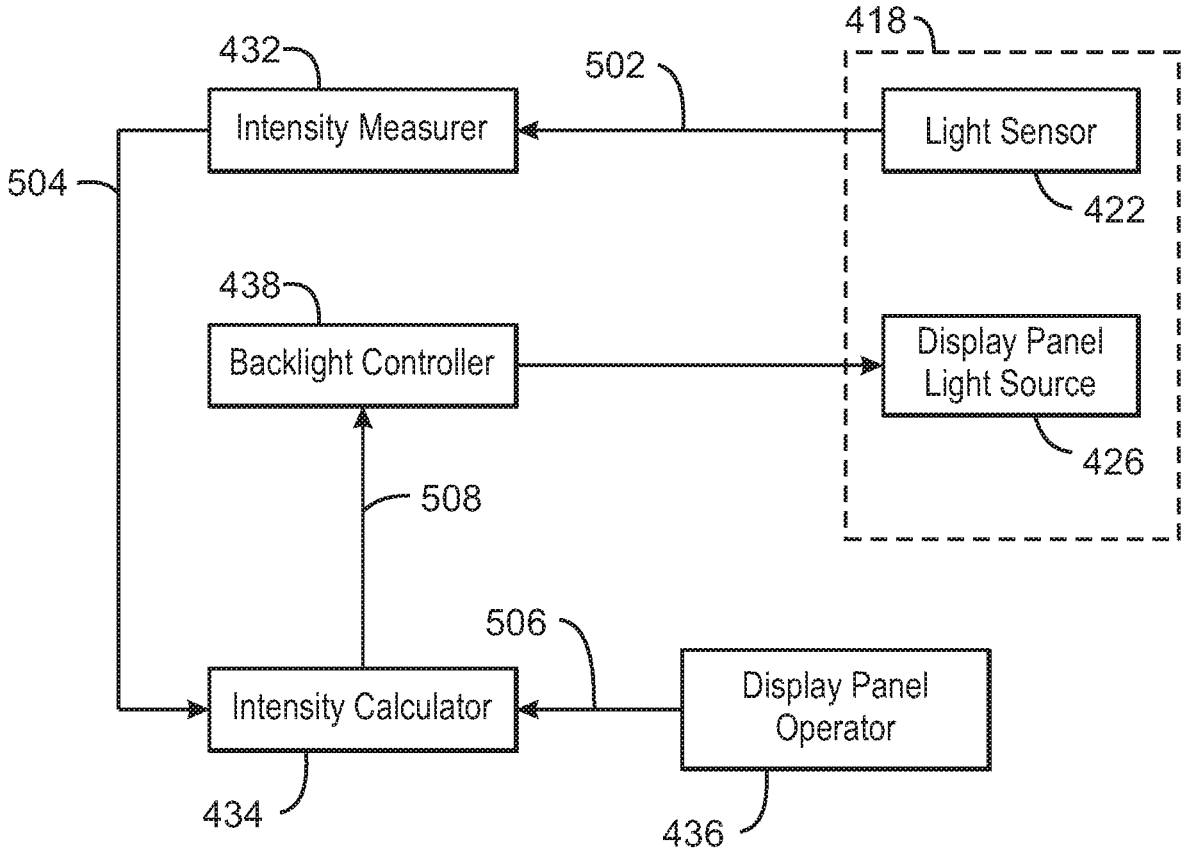
FIG. 5 is a simplified block diagram of the example compute device showing components used to adjust light intensity in a display panel to limit light bleed at an edge.

FIG. 5 is a simplified block diagram of the example compute device 400 showing components used to adjust light intensity in a display panel to limit light bleed at an edge. Like numbered items are as described with respect to FIG. 4.

The simplified block diagram also indicates the basic flow of data and control signals between units in the example compute device 400. Readings 502 from the light sensor 422 are provided to the intensity measurer 432. The intensity measurer 432 may determine the light intensity over a region of the display panel 418, and provide the expected light intensity 504 to the intensity calculator 434.

The intensity calculator 434 may obtain pixel values 506 from a display panel operator 436. The intensity calculator 434 may then calculate the expected light intensity over region of the display panel 418 and compare that to the measured light intensity 504. An ambient light intensity measurement may be used to compensate for the ambient light in the environment of the display panel 418. The intensity calculator 434 may then determine adjustments 508 that should be made to the display panel light source 426 to maintain the light intensity at the correct values, lowering or eliminating backlight bleeding around the edges of the display panel 418.

The adjustments 508 may be provided to the backlight controller 438 to adjust the LEDs, or other light sources, in the display panel light source 426. This may be performed as described with respect to FIGS. 3 and 4.

Figure 6:
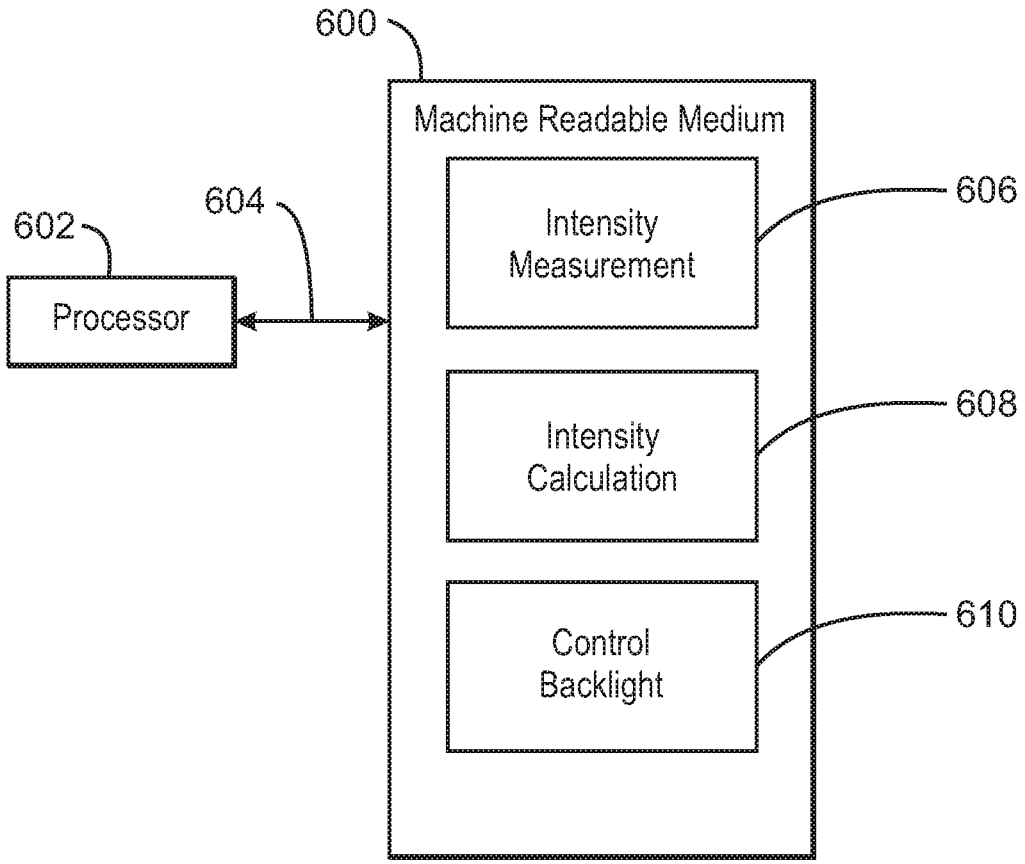
FIG. 6 is a block diagram of an example non-transitory, machine readable medium comprising code to direct a processor to adjust light intensity in a display panel limit light bleed at an edge.

FIG. 6 is a block diagram of an example non-transitory, machine-readable medium 600 comprising code to direct a processor 602 to adjust light intensity in a display panel to lower or eliminate light bleed at an edge. The non-transitory, machine-readable medium 600 may include the storage 408 of FIG. 4, the memory 406 of FIG. 4, or other machine-readable media, such as SD cards, programmable memory, and the like. The processor 602 may access the machine-readable medium 600 over a bus 604, which may be as described with respect to the bus 404 of FIG. 4.

The machine-readable medium 600 may include code 606 to direct the processor 602 to perform a light intensity measurement, as described herein. The light intensity measurement may be performed using sensors over the front surface of the display panel, and may include performing light intensity measurements using sensors to determine an ambient light measurement. Code 608 may be included to direct the processor 602 to perform an intensity calculation, as described herein. This may include directing the processor 602 to use data from light intensity measurements and pixel values to calculate an expected brightness, or light intensity, over region. The code 608 may determine that backlight bleeding is present in a region of the display, for example, if the light intensity measured is greater than the light intensity that is calculated. The code 608 may determine an adjustment to the backlight to compensate for backlight bleeding, changing ambient light conditions, and the like.

The machine-readable medium 600 may include code 610 to control the backlight. This may include, for example, increasing or decreasing the light output by a display panel light source for a portion, or all, of the display.

While the present techniques may be susceptible to various modifications and alternative forms, the exemplary examples discussed above have been shown only by way of example. It is to be understood that the technique is not intended to be limited to the particular examples disclosed herein. Indeed, the present techniques include all alternatives, modifications, and equivalents falling within the scope of the present techniques.

What is claimed is:

1. A system comprising:

a display panel comprising an adjustable light source;

a light sensor disposed within a sensing distance of the display panel on an opposite surface from the adjustable light source and facing inward toward the adjustable light source, the sensing distance being a distance suitable for the light sensor to sense light of the display panel, wherein the display panel includes a first side and a second side opposite to the first side, wherein the adjustable light source is disposed on the first side of the display panel and the light sensor is disposed on the second side of the display panel such that the display panel separates the adjustable light source from the light sensor; and a controller to measure an intensity of light from the light sensor and to control an intensity of the adjustable light source, based, at least in part, on the intensity of the light.

2. The system of claim 1, wherein the adjustable light source comprises a light emitting diode (LED).

3. The system of claim 2, comprising a plurality of LEDs disposed in an array across a panel disposed on an opposite surface of the display panel from the light sensor.

4. The system of claim 1, comprising a plurality of light sensors disposed in a bezel.

5. The system of claim 1, wherein the adjustable light source comprises a fluorescent tube.

6. The system of claim 1, wherein the light sensor comprises a phototransistor, a photodiode, a photoresistor, or any combinations thereof.

7. The system of claim 1, where the controller comprises a pulse width modulation drive.

8. The system of claim 1, wherein the display panel comprises a thin film transistor panel disposed between two polarization filters, wherein the polarization filters are disposed at a 90° orientation to each other.

9. The system of claim 1, wherein the light sensor is disposed such that a sensing direction of the light sensor is perpendicular to a direction of emission of light by the adjustable light source through the display panel.

10. The system of claim 1, wherein the light sensor is to detect an amount of light emitted by the adjustable light source through the display panel.

11. A method comprising:

calculating, via a light sensor, an expected light intensity in a region of a display panel, the light sensor disposed within a sensing distance of the display panel on an opposite surface from the adjustable light source and facing inward toward the adjustable light source, wherein the display panel includes a first side and a second side opposite to the first side, wherein the adjustable light source is disposed on the first side of the display panel and the light sensor is disposed on the second side of the display panel such that the display panel separates the adjustable light source from the light sensor;

measuring a light intensity at a front edge of the display panel; and adjusting a first portion of a light source to match the measured light intensity to the expected light intensity while retaining a second portion of the light source unadjusted.

12. The method of claim 11, comprising calculating the expected light intensity based, at least in part, on pixel values for the region.

13. The method of claim 11, comprising:

measuring an ambient light intensity; and adjusting the light source based, at least in part, on the ambient light intensity.

14. The method of claim 11, wherein adjusting the light source comprises cycling through a pattern of light intensity across a plurality of light emitting diodes in an array.

15. A non-transitory, machine readable medium comprising instructions to direct a processor to:

measure, via a light sensor, a light intensity at a front edge of a display panel, the light sensor disposed within a sensing distance of the display panel on an opposite surface from the adjustable light source and facing inward toward the adjustable light source, wherein the display panel includes a first side and a second side opposite to the first side, wherein the adjustable light source is disposed on the first side of the display panel and the light sensor is disposed on the second side of the display panel such that the display panel separates the adjustable light source from the light sensor;

measure an ambient light intensity;

calculate an expected light intensity for the display panel from a display panel operator; and adjust a first portion of a light source to match the light intensity to the expected light intensity while retaining a second portion of the light source unadjusted.

16. The non-transitory, machine readable medium of claim 15 comprising instructions to direct the processor to adjust the light source based, at least in part, on the ambient light intensity.

17. The non-transitory, machine readable medium of claim 15 comprising instructions to direct the processor to determine the expected light intensity based, at least in part, on values for pixels in a region of the display panel.

* * * * *